US011612931B2

(12) United States Patent
Strolego et al.

(10) Patent No.: US 11,612,931 B2
(45) Date of Patent: Mar. 28, 2023

(54) ELECTROMAGNETIC STIRRING DEVICE IN A MOULD FOR CASTING ALUMINIUM OR ALUMINIUM ALLOYS, STIRRING METHOD IN A MOULD FOR CASTING ALUMINIUM OR ALUMINIUM ALLOYS, MOULD AND CASTING MACHINE FOR CASTING ALUMINIUM OR ALUMINIUM ALLOYS

(71) Applicant: ERGOLINES LAB S.R.L., Trieste (IT)

(72) Inventors: Sabrina Strolego, Trieste (IT); Stefano De Monte, Trieste (IT); Stefano Spagnul, Trieste (IT); Cristiano Persi, Trieste (IT)

( * ) Notice: Subject to any disclaimer, the term of this patent is extended or adjusted under 35 U.S.C. 154(b) by 125 days.

(21) Appl. No.: 17/274,240

(22) PCT Filed: Aug. 28, 2019

(86) PCT No.: PCT/EP2019/000247
§ 371 (c)(1),
(2) Date: Mar. 8, 2021

(87) PCT Pub. No.: WO2020/052794
PCT Pub. Date: Mar. 19, 2020

(65) Prior Publication Data

US 2021/0354194 A1 Nov. 18, 2021

(30) Foreign Application Priority Data

Sep. 10, 2018 (IT) ..... 102018000008465

(51) Int. Cl.
*B22D 11/115* (2006.01)
*B22D 7/00* (2006.01)
(Continued)

(52) U.S. Cl.
CPC ..... *B22D 11/115* (2013.01); *B22D 7/005* (2013.01); *B22D 7/10* (2013.01); *B22D 9/003* (2013.01); *B22D 11/003* (2013.01); *B22D 27/02* (2013.01)

(58) Field of Classification Search
CPC . B22D 7/00; B22D 7/005; B22D 7/10; B22D 9/00; B22D 9/003; B22D 11/00; B22D 11/003; B22D 11/115; B22D 27/02
(Continued)

(56) References Cited

U.S. PATENT DOCUMENTS 4,877,079 A 10/1989 Long
5,279,351 A 1/1994 Metz

FOREIGN PATENT DOCUMENTS

EP 0374563 A1 6/1990
JP H06182512 A 7/1994
(Continued)

OTHER PUBLICATIONS

International Search Report for corresponding PCT/EP2019/000247, dated Oct. 3, 2019.
(Continued)

*Primary Examiner* — Kevin P Kerns
(74) *Attorney, Agent, or Firm* — Egbert, McDaniel & Swartz, PLLC

(57) ABSTRACT

Electromagnetic stirring device in a mould for casting aluminium or aluminium alloys, wherein the electromagnetic stirring device has a winding core of conductive coils intended for the circulation of a current generating an electromagnetic field of stirring of the molten metal inside the mould. A mould, casting machine and casting plant provided with such an electromagnetic stirring device are also provided. A stirring method in a mould for casting aluminium or aluminium alloys is disclosed, including a
(Continued)

phase of supply of phase-shifted currents on an electromagnetic stirring device in a mould.

31 Claims, 9 Drawing Sheets

(51) Int. Cl.

| | |
|---|---|
| ***B22D 9/00*** | (2006.01) |
| ***B22D 11/00*** | (2006.01) |
| ***B22D 27/02*** | (2006.01) |
| ***B22D 7/10*** | (2006.01) |

(58) Field of Classification Search
USPC .... 164/499, 147.1, 466, 467, 468, 502, 503, 164/504
See application file for complete search history.

(56) References Cited

FOREIGN PATENT DOCUMENTS

| | | | | |
|---|---|---|---|---|
| WO | WO 01/36130 A1 * | 5/2001 | ..... | B22D 11/10 |
| WO | WO 2011/005466 A2 * | 1/2011 | ..... | H05B 6/54 |

OTHER PUBLICATIONS

Written Opinion of the International Searching Authority for corresponding PCT/EP2019/000247, dated Oct. 3, 2019.

* cited by examiner

Sect. B-B

Sect. A-A

Det. C

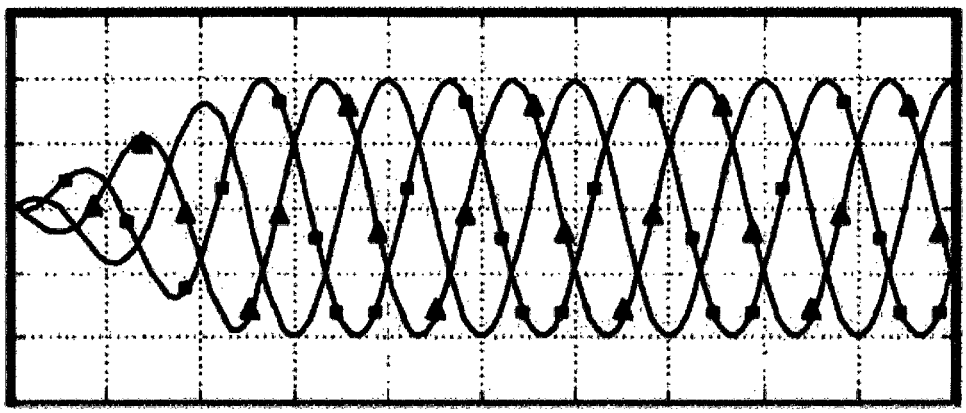
— $I_{34}$
—•— $I_{35}$
—▲— $I_{36}$
Fig. 13
Fig. 14
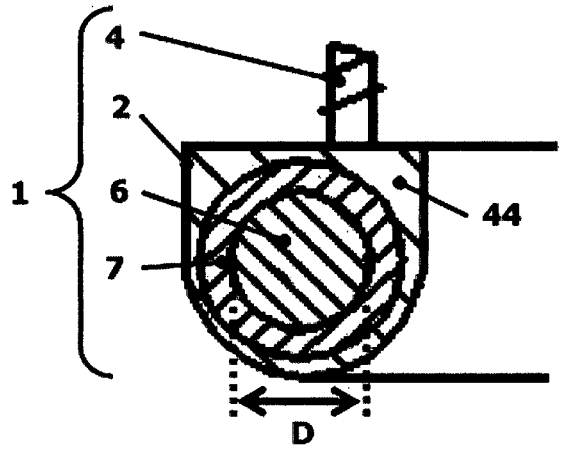

ELECTROMAGNETIC STIRRING DEVICE IN A MOULD FOR CASTING ALUMINIUM OR ALUMINIUM ALLOYS, STIRRING METHOD IN A MOULD FOR CASTING ALUMINIUM OR ALUMINIUM ALLOYS, MOULD AND CASTING MACHINE FOR CASTING ALUMINIUM OR ALUMINIUM ALLOYS

TECHNICAL FIELD

The present invention relates to an electromagnetic stirring device in a mould for casting aluminium or aluminium alloys, a stirring method in a mould for casting aluminium or aluminium alloys, a mould and related casting machine for casting aluminium or aluminium alloys, according to the characteristics of the pre-characterizing part of the appended independent claims.

DEFINITIONS

In the present description and in the appended claims the following terms must be understood according to the definitions given in the following.

The expression "metal bar" comprises all kinds of products of a casting machine, such as billets, blooms or slabs having different shapes in section, such as a square, rectangular, round, polygonal section.

The expression "casting machine" comprises both vertical casting machines and casting machines provided with a curvature.

The expression "meniscus" indicates the surface area of the metal in the molten state inside the mould, that is to say, the area of the metal in the molten state in correspondence of the maximum level of metal in the molten state inside the mould.

The expression "Hot-Top casting machine" indicates a vertical casting machine in which the metal in the molten state enters one or more moulds through some open channels in the upper part. The moulds themselves are open in the upper part where the molten alloy forms said meniscus.

PRIOR ART

In the field of production of metal products the technique of casting molten metals inside a mould is known to obtain metal ingots of various shapes and sizes in section and length wherein the obtained metallic ingots constitute the raw material for following machining processes intended to obtain the desired metal products.

Furthermore, it is known to use electromagnetic stirring devices in a mould, which are known as stirrers and which, by the generation of electromagnetic fields, induce a movement of the metal in the liquid state, promoting a homogenization of the metal in the liquid state during the casting process in the mould, thus obtaining improved production quality.

Solutions are known in which the stirrer is made in the form of an inductor with windings coaxial to the product cast in the mould that produces repulsion forces that vary the contact pressure between the cast molten metal and the crystallization vessel during solidification creating a so-called "soft contact" condition to improve superficial quality. Patent application JP H06 182512 describes a solution of an electromagnetic stirrer for improving stirring efficiency by making the loss of the magnetic flux generated in a toroidal bobbin very small and by making the magnetic flux in a mould for molten steel high. The electromagnetic stirrer consists of a toroidal bobbin having a core consisting of an electrically conductive material and arranged in the external peripheral part of the mould consisting of electrically conductive material of copper or copper alloy. The thickness and the material of the core are selected in such a way that the degree of attenuation of the magnetic flux of propagation of the magnetic field is lower than the degree of attenuation of the magnetic flux from the mould.

Patent application EP 0 374 563 describes a solution of an electromagnetic stirrer for continuous casting, comprising at least one iron core provided with coils. The iron core is provided with a damping plate of electrically conducting material, forming a closed magnetic circuit, intended to damp the propagation of the magnetic field in the direction in which the damping plate is placed in relation to the iron core.

Patent application U.S. Pat. No. 4,877,079 describes a solution of a mould for casting in a continuous casting line, which is provided with a counterflow electromagnetic stirring device disposed about the mould. The counterflow electromagnetic stirring device includes electrically conductive coils arranged in first and second groups of adjacent coils with the coils connected together in predetermined phase relationships for generating magnetic fields in molten metal flowing through the casting mould. The first and second groups of adjacent coils are disposed respectively along respective halves of the casting mould with the coils in the first group generating one magnetic field and the coils in the second group generating another magnetic field. The magnetic fields so generated in the molten metal move in counter rotating relation to one another about respective spaced axes extending generally parallel to one another and to the longitudinal axis of the casting mould. The counter rotating movement of the magnetic fields extends in transverse relation to the direction of the molten metal flow through the casting mould and produces a movement of molten metal in clockwise and counterclockwise stirring patterns in the casting mould in which the molten metal flowing in the respective patterns collide and intermix at the interface of the patterns.

Patent application U.S. Pat. No. 5,279,351 describes a solution of an electromagnetic stirring process for continuous casting in which the induction coils are supplied with a multiphase current so as to create in a molten metal at least one primary rotational movement zone which is offset with respect to a central casting axis. This primary rotational movement zone is also revolved in a secondary gyratory movement around the central casting axis by a cyclic commutation of each phase of the current.

PROBLEMS OF THE PRIOR ART

Although the employment of electromagnetic stirrers in a mould is known, their use is essentially limited to the application of casts of ferrous metal materials and steel while their use in the casting of aluminium or aluminium alloys is limited to particular applications that are not suitable for moulds of the type herein considered, and namely moulds for casting machines called "Hot-Top".

The main problem of the prior art solutions concerns the excessive dimensions of the stirrers of the known type that do not allow to install them in a position suitable for obtaining the desired metallurgical effects. Furthermore, such solutions have turned out to be incompatible with the spaces available in industrial installations.

The known solutions of a stirrer made in the form of an inductor with windings coaxial to the product that produces repulsion forces, although contributing to an improvement in terms of a reduction in defects on the surface, are unable to generate effects of homogenization of the bath, unlike the solutions that induce a stirring of the molten metal bath in the mould.

AIM OF THE INVENTION

The aim of the present invention is to provide a stirrer in a mould for casting aluminium and aluminium alloys which can be advantageously applied and is effective in the casting of aluminium and aluminium alloys in a mould, particularly moulds for casting machines called "Hot-Top".

A further aim of the present invention is to provide a stirring method in a mould for casting aluminium and aluminium alloys which allows to obtain an effective stirring action of the bath in the mould in the solidification starting zone.

Another aim of the present invention is to provide mould and a casting machine for casting aluminium and aluminium alloys in which a stirrer is applied or in which the described stirring method in a mould for casting aluminium and aluminium alloys is applied.

CONCEPT OF THE INVENTION

The aim is achieved by means of the characteristics of the main claim. The sub-claims represent advantageous solutions.

ADVANTAGEOUS EFFECTS OF THE INVENTION

The solution according to the present invention, by the considerable creative contribution the effect of which constitutes an immediate and important technical progress, has various advantages.

Advantageously the stirrer, the method and their application to a mould and casting machine for casting aluminium and aluminium alloys allow to obtain an effective stirring action of the bath in the mould, said stirring action being also considerably improved with respect to any known traditional solutions of stirrers designed for steel or iron alloys.

Advantageously the stirrer, the method and their application to a mould and casting machine for casting aluminium and aluminium alloys allow to obtain a better homogenization in the solidification phase of the aluminium or aluminium alloy with the consequence that there is a remarkable reduction in the occurrence of defects on the surface, such as under-skin cracks. Another effect consists of the transformation of the typically dendritic solidification structure into a fine-grained equiaxial/globular structure.

Consequently the quality of the obtained products in the form of bars is higher.

Furthermore, the remarkable reduction in the occurrence of defects on the surface so obtained also allows to avoid following re-machining of the bars by heating in a furnace and post-treatments and, in particular, the homogenization process of the grain, with consequent important advantages in terms of cost-effectiveness, obtaining lower production costs as well as shorter production times.

In a particularly advantageous embodiment, the stirrer according to the invention does not include cooling systems, making its installation in a mould simpler and also enabling a reduction in the costs for making the stirrer and a simplification of its management and maintenance by the user.

DESCRIPTION OF THE DRAWINGS

In the following a solution is described with reference to the enclosed drawings, which are to be considered as a non-limiting example of the present invention in which:

FIG. 13 schematically shows a diagram of the driving currents applied by means of the connection diagram of FIG. 12.

FIG. 14 shows a different embodiment of the stirrer made according to the present invention.

DESCRIPTION OF THE INVENTION

Figure 1:
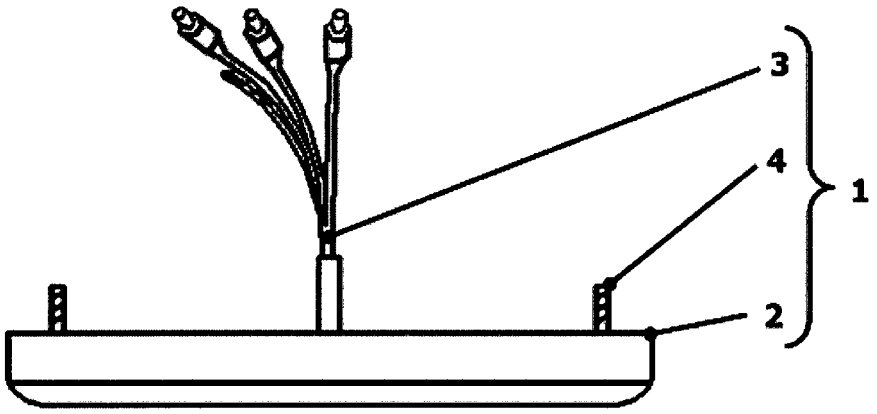
FIG. 1 is a side view of the stirrer made according to the present invention.
Figure 2:
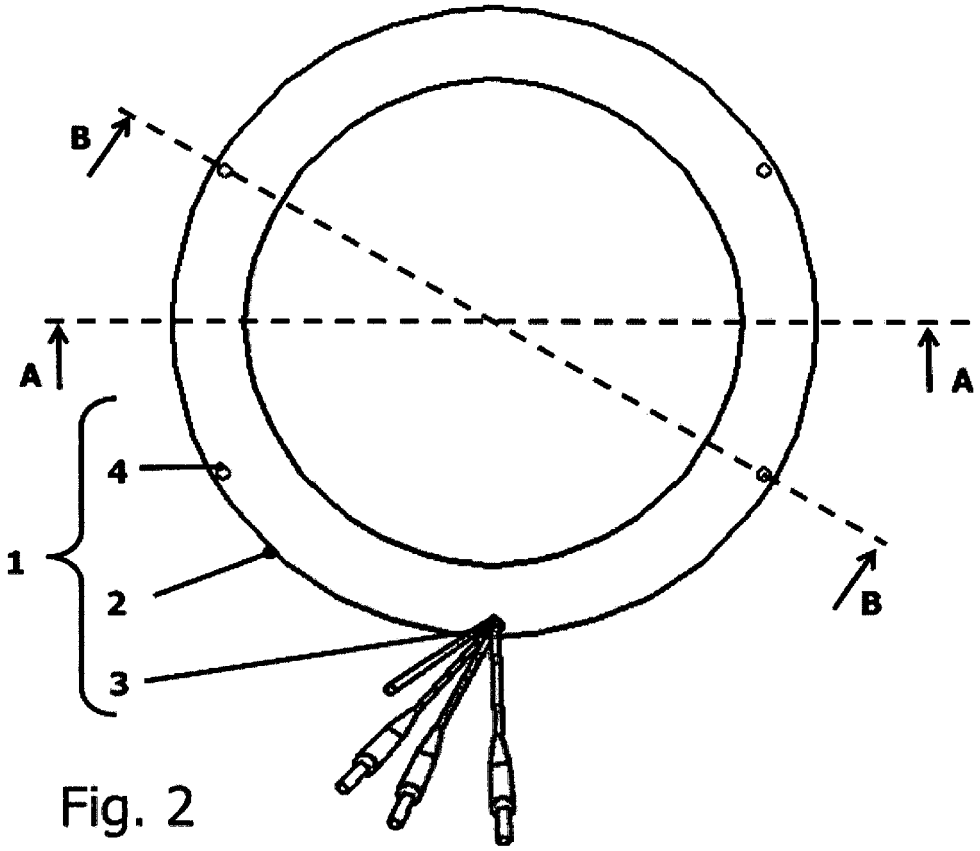
FIG. 2 is a plan view of the stirrer of FIG. 1.
Figure 3:
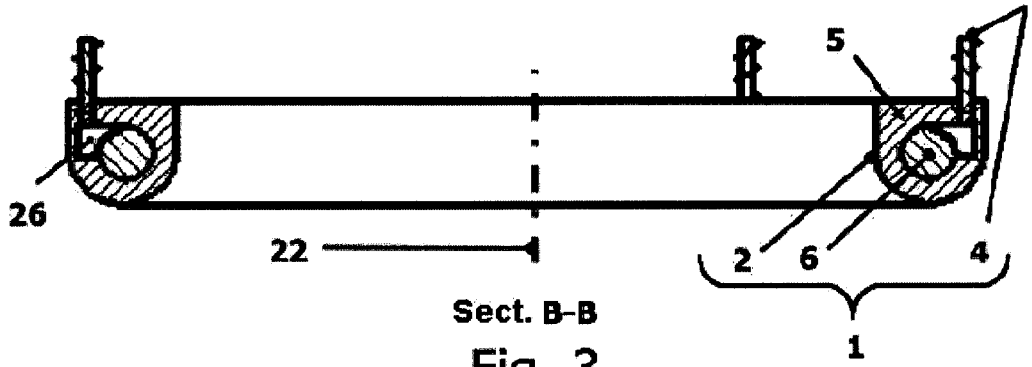
FIG. 3 is a view of the stirrer of FIG. 2 according to the section line B-B.
Figure 4:
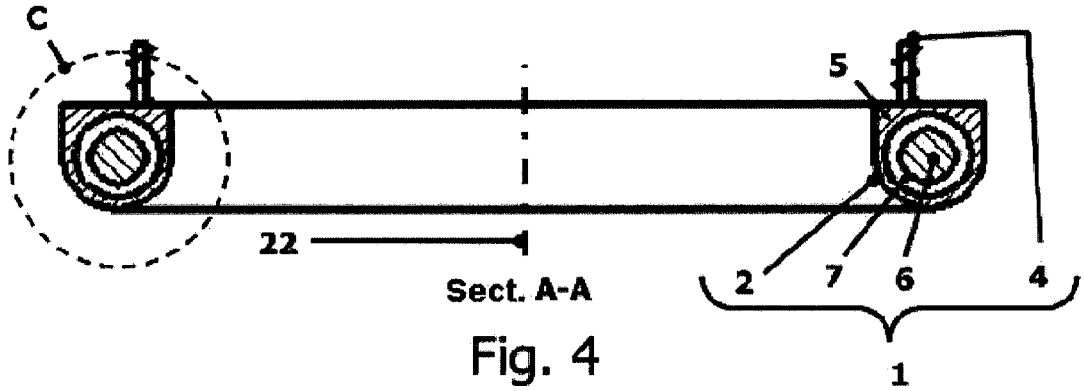
FIG. 4 is a view of the stirrer of FIG. 2 according to the section line A-A.
Figure 5:
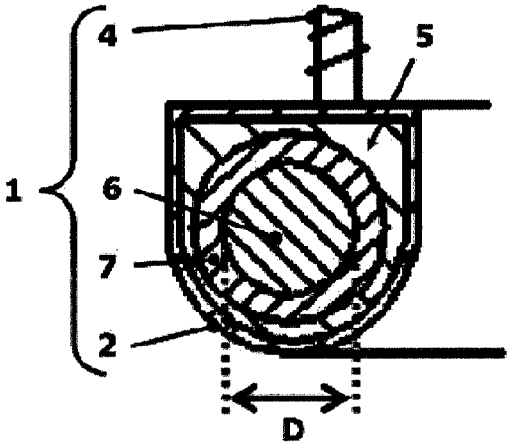
FIG. 5 is a view of the detail denoted as C in FIG. 4.
Figure 6:
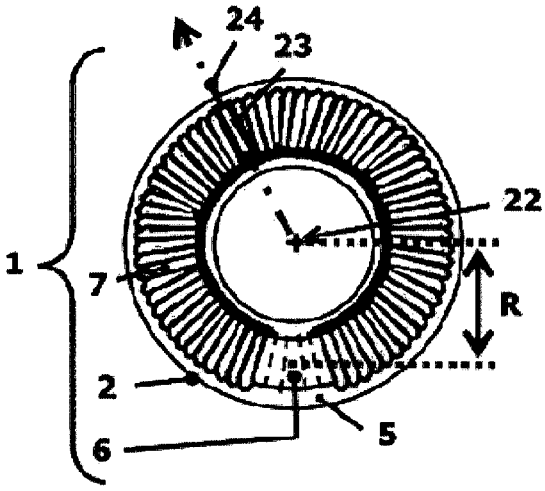
FIG. 6 is a schematic view showing the winding configuration of the stirrer made according to the present invention.
Figure 7:
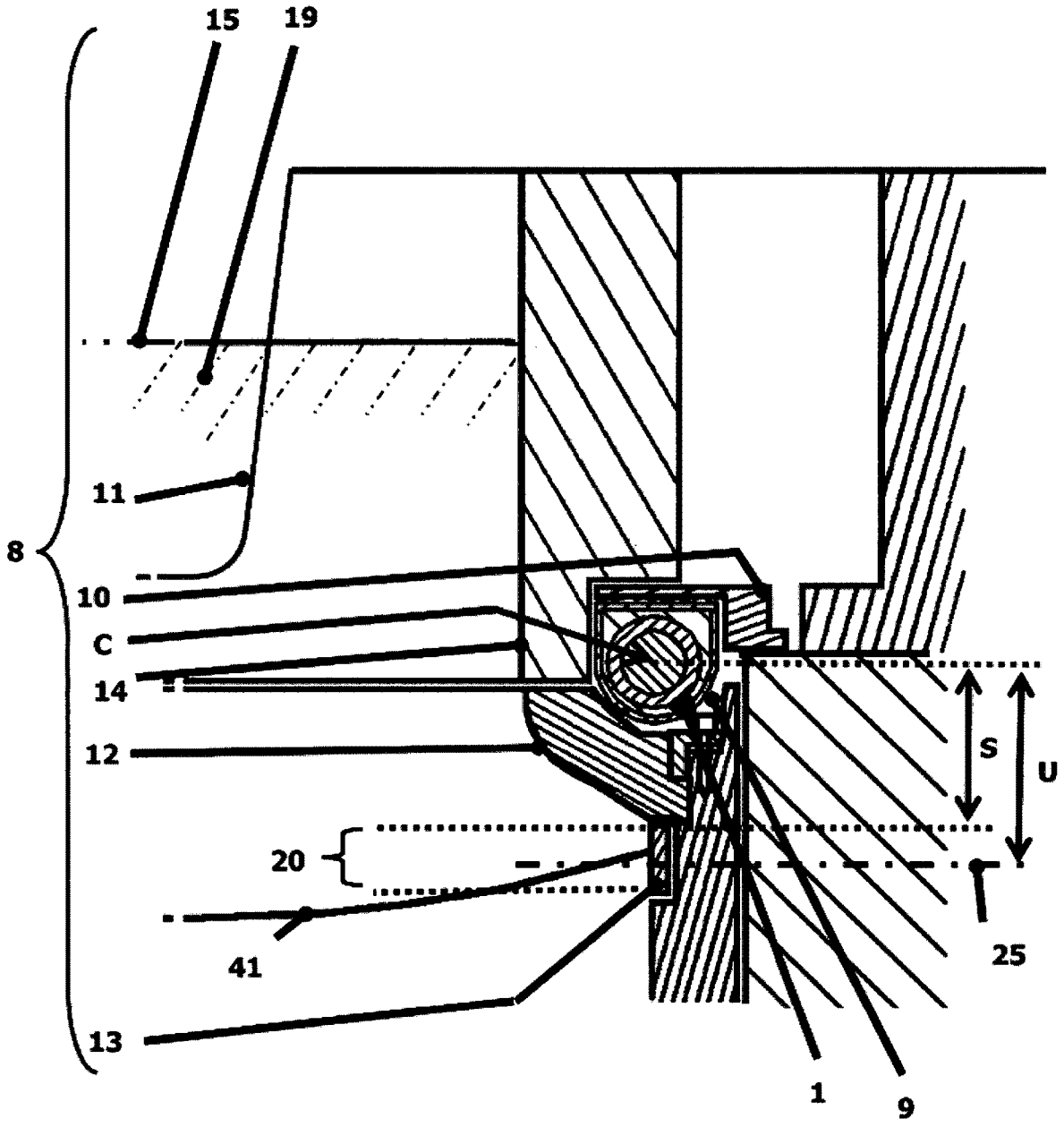
FIG. 7 is a schematic sectional view of a first possible embodiment of a mould incorporating on its inside a stirrer made according to the present invention.
Figure 8:
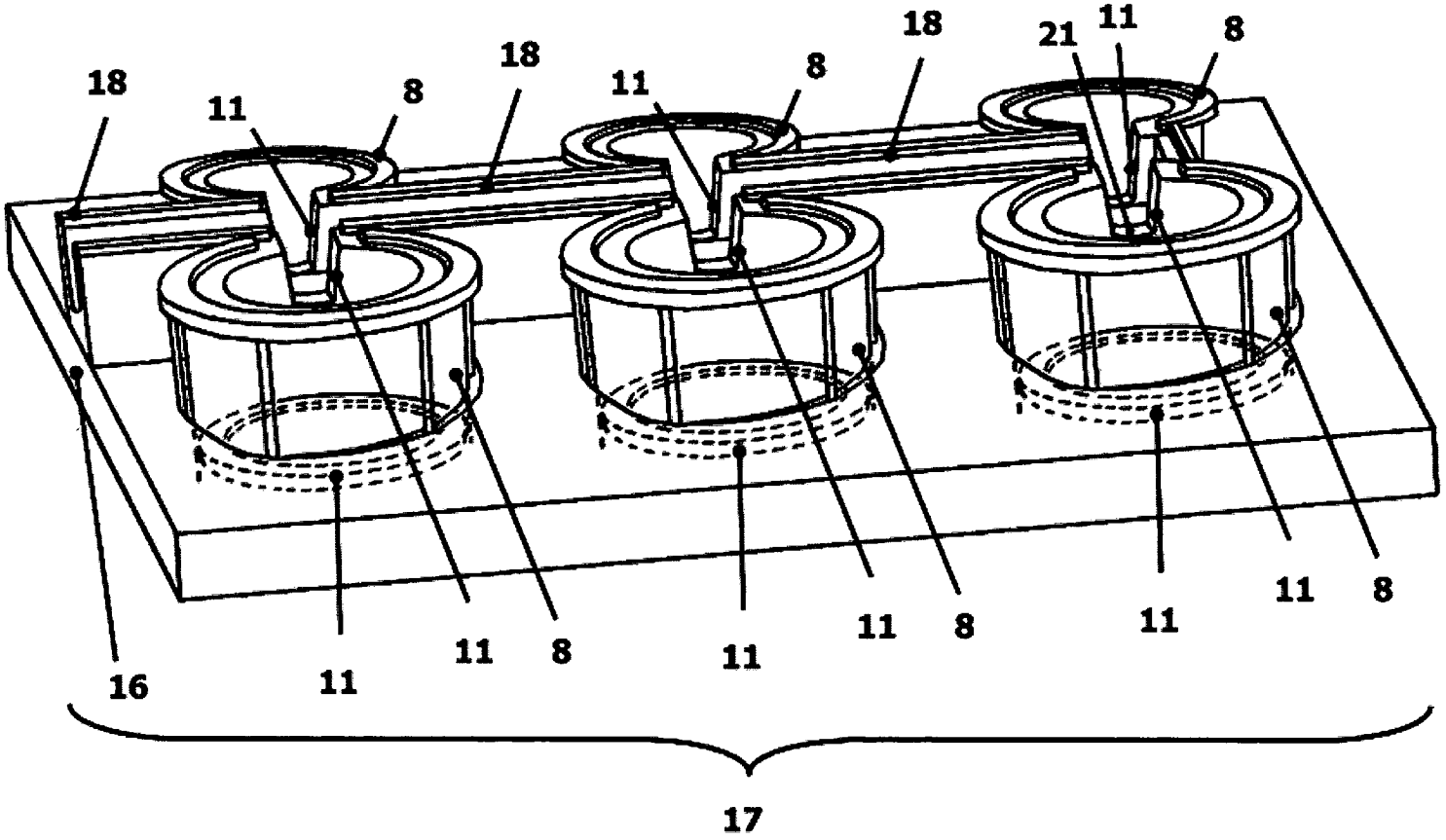
FIG. 8 is a schematic perspective view of a possible embodiment of a casting bench comprising a series of moulds each incorporating on its inside a stirrer made according to the present invention.
Figure 15:
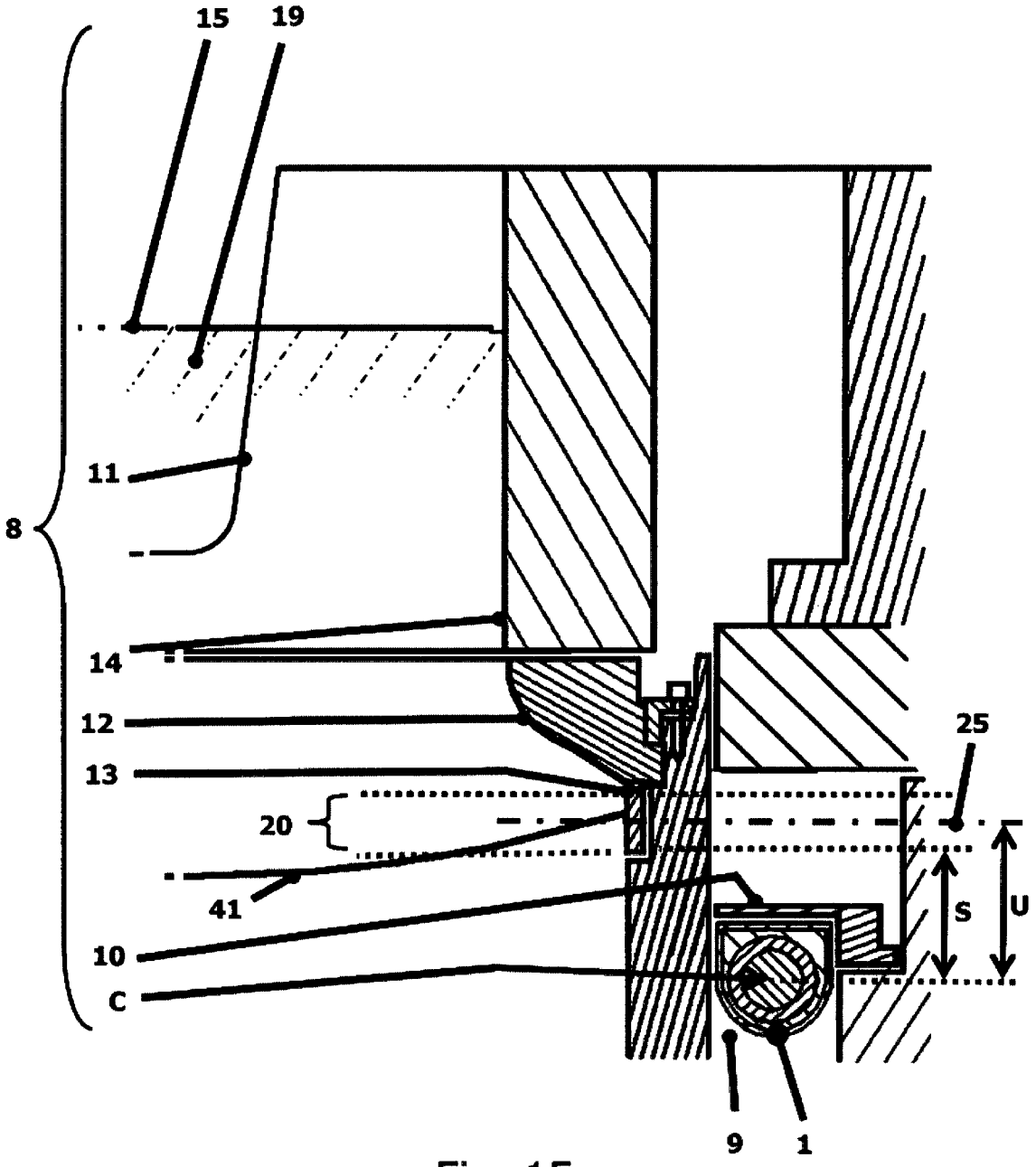
FIG. 15 shows a schematic sectional view of a second possible embodiment of a mould incorporating on its inside a stirrer made according to the present invention.

The present invention relates to (FIG. 1, FIG. 2, FIG. 3, FIG. 4, FIG. 5, FIG. 6, FIG. 14) a stirrer (1) in a mould for casting molten metal in the form of aluminium or aluminium alloys. The stirrer (1) can be installed inside (FIG. 7, FIG. 15) a casting mould (8) for casting molten metal (19) in the form of aluminium or aluminium alloys, particularly a mould of a casting machine of the known type called "Hot-Top" comprising (FIG. 8) a casting bench (17) provided with a base (16) for mounting a series of moulds (8) fed by a distribution channel (18) of the molten metal (19) in the form of aluminium or aluminium alloys.

The present invention also relates to a stirring method in a mould for casting aluminium or aluminium alloys, able to generate (FIG. 9, FIG. 10) a rotation of the molten metal bath (19) in the form of aluminium or aluminium alloys in which the induced rotation is such as to affect an extension zone of the molten metal bath (19) that comprises at least the portion between (FIG. 7 FIG. 15) the level (15) corresponding to the position of the meniscus and a portion placed below a solidification starting zone (20) in correspondence of a ring (13) that promotes the formation of the external solidification skin of the bar of aluminium or aluminium alloys being formed. In correspondence of the ring (13), in fact, the solidification front (41) of the molten metal (19) is formed (FIG. 7, FIG. 15), which initially solidifies in correspondence of the wall of the mould (8) on the ring (13) giving rise to the formation of a perimetric solidification skin enclosing molten metal (19) whose solidification continues as the bar being formed is extracted from the mould (8).

Advantageously the solution according to the invention allows to obtain an effective stirring action in the casting in a mould of molten metal (19) in the form of aluminium or aluminium alloys, said effect not being achievable by means of the known solutions of stirrers used in different fields with respect to the casting in a mould of aluminium or aluminium alloys.

Thanks to a combination of characteristics of the stirrer according to the invention and of the related method, it is possible to install the stirrer (1) in the casting mould (8) for casting aluminium or aluminium alloys in a particularly effective position in terms of the induced stirring and in a close position with respect to the molten metal (19) inside the mould (8).

In a particularly advantageous embodiment, the stirrer (1) according to the invention does not include a cooling system of the windings for the passage of the induction current, with consequent advantages in terms of an easier installation and simplified management during the casting operations, as well as in terms of production and installation costs. In fact, the known solutions of stirrers make use of a cooling system by means of liquid circulating to cool the windings for the passage of the induction current. The presence of this cooling action is a problem because it is necessary to set up the mould with suitable connections of the cooling circuit, fluid circulation stations able to ensure cooling in emergency conditions as well, filtering systems. Thanks to the specific characteristics of the stirrer (1) and/or of its method of use, it is possible to obtain a solution of a stirrer (1) devoid of a cooling system of the induction windings.

The stirrer (1) consists of a body (2), in which the body (2) preferably has a closed annular shape in such a way that the stirrer (1) can be applied (FIG. 7, FIG. 8, FIG. 15) on the mould (8) so as to surround a portion of the molten metal bath (19) of aluminium or aluminium alloys.

The body (2) can have a circular shape in section or, as in the case shown (FIG. 3, FIG. 4, FIG. 5), a polygonal shape for example consisting of a lower circular portion and an upper quadrangular portion joined to each other to form a closed polygonal shape constituting the section of the body (2) of the stirrer (1).

In more detail, the upper part of the body (2) is preferably flat both to facilitate assembly and to enable the arrangement of a terminal board (40) for the electrical connection of the connections (3) of the internal wiring, optionally resorting to a multipole connector. The side and lower part of the body (2), on the other hand, can have a circular, quadrangular or polygonal shape depending on the installation requirements. A circular or polygonal shape is generally preferred because it better matches the shape of the refractory material inside which the stirrer is inserted and thus allows to approach the molten metal contained in the installed mould as much possible, maximizing the stirring effect.

The stirrer (1) is installed (FIG. 7, FIG. 15) in the vicinity of the wall of the mould (8) for example in the vicinity of the refractory material of the mould (8), in such a way as to be able to act more effectively on the molten metal bath (19) of aluminium or aluminium alloys. The stirrer (1) is preferably installed (FIG. 7, FIG. 15) in a condition of non-direct contact with the wall of the mould (8), especially in the preferred embodiments in which the stirrer is not cooled. In fact, in case of absence of cooling of the stirrer, a spacing condition of the stirrer with respect to the wall, for example, the wall of refractory material, in the absence of contact between them, reduces temperature exchange with transfer of heat from the wall to the stirrer, this factor contributing to the use of non-cooled stirrers with all the consequent advantages in terms of cost-effectiveness and simplicity of installation.

In particular the applicants have found an optimal installation position that allows to obtain the best stirring effects with respect to the other possible positions of the stirrer. In fact, a too low positioning of the stirrer inside the mould (8) would induce the stirring of the molten metal bath (19) of aluminium or aluminium alloys in a zone in which the formation of the solid superficial skin of the bar being formed is already in an advanced state, with the consequence that the stirrer would not be effective for the desired reduction in the occurrence of defects on the surface. A too high positioning of the stirrer inside the mould (8) would induce the stirring of the molten metal bath (19) of aluminium or aluminium alloys in a zone too far from the zone of formation of the solid superficial skin of the bar being formed, with the consequence that the stirrer would not be effective for the desired reduction in the occurrence of defects on the surface and for the reduction in the size of the globular grain unless increasing the power of the stirrer, for example, by applying currents of greater intensity, which, however, would imply a reduced effectiveness with respect to the solution found, in addition to inevitably leading to the need of providing the stirrer with a cooling system for removing the heat generated by the passage of high-intensity currents in the windings of generation of the electromagnetic field of stirring. An installation too close to the meniscus or a too vigorous action of the stirrer may also cause the oxide film protecting the molten alloy to break with a consequent introduction of oxides into the solidified metal bar.

Therefore, the present invention does not relate only to the making of a stirrer (1) in a mould for casting molten metal in the form of aluminium or aluminium alloys, but also to a method in which one finds an optimal installation position that allows to obtain the previously mentioned advantages among which a greater operating effectiveness of the stirrer that, in turn, enables the use of lower-intensity currents thus eliminating the need for a specific cooling system for the windings of the stirrer.

In particular, an optimal position is (FIG. 7) in the vicinity of a zone of the mould (8) that corresponds to the section change zone of the mould, in which the section of the mould passes from a first zone having a smaller diameter that constitutes the introduction portion (14) of the molten metal of aluminium or aluminium alloys into the mould through an introduction mouth (11) of an introduction channel (21) arranged (FIG. 8) horizontally and laterally with respect to the mould (8). The introduction portion (14) of the molten metal of aluminium or aluminium alloys can be made in the form of an introduction vessel made of refractory material.

Another optimal position is (FIG. 15) below the zone of the mould (8) in which there is the ring (13) that promotes the formation of the skin.

Inside the body (2) of the stirrer (1) a winding (7) is applied (FIG. 6), which consists of at least one layer of conductor wire wound on a core (6) according to a toroidal winding configuration defined by the average radius (R) of the toroidal core (6) and the diameter (D) in section of the toroidal core (6). For example, the winding (7) can be made in the form of a number of coils included between 50 and 200 coils, preferably about 100 coils, wherein the coils are coils of enameled copper wire wound on a core having a diameter (D) between 10 and 40 mm. The windings can for example be windings of an enameled copper wire having a diameter between 0.5 and 3 mm.

The toroidal shape of the core (6) is preferably a circular toroidal shape having a diameter of the toroidal shape between 110 and 450 mm.

Figure 11:
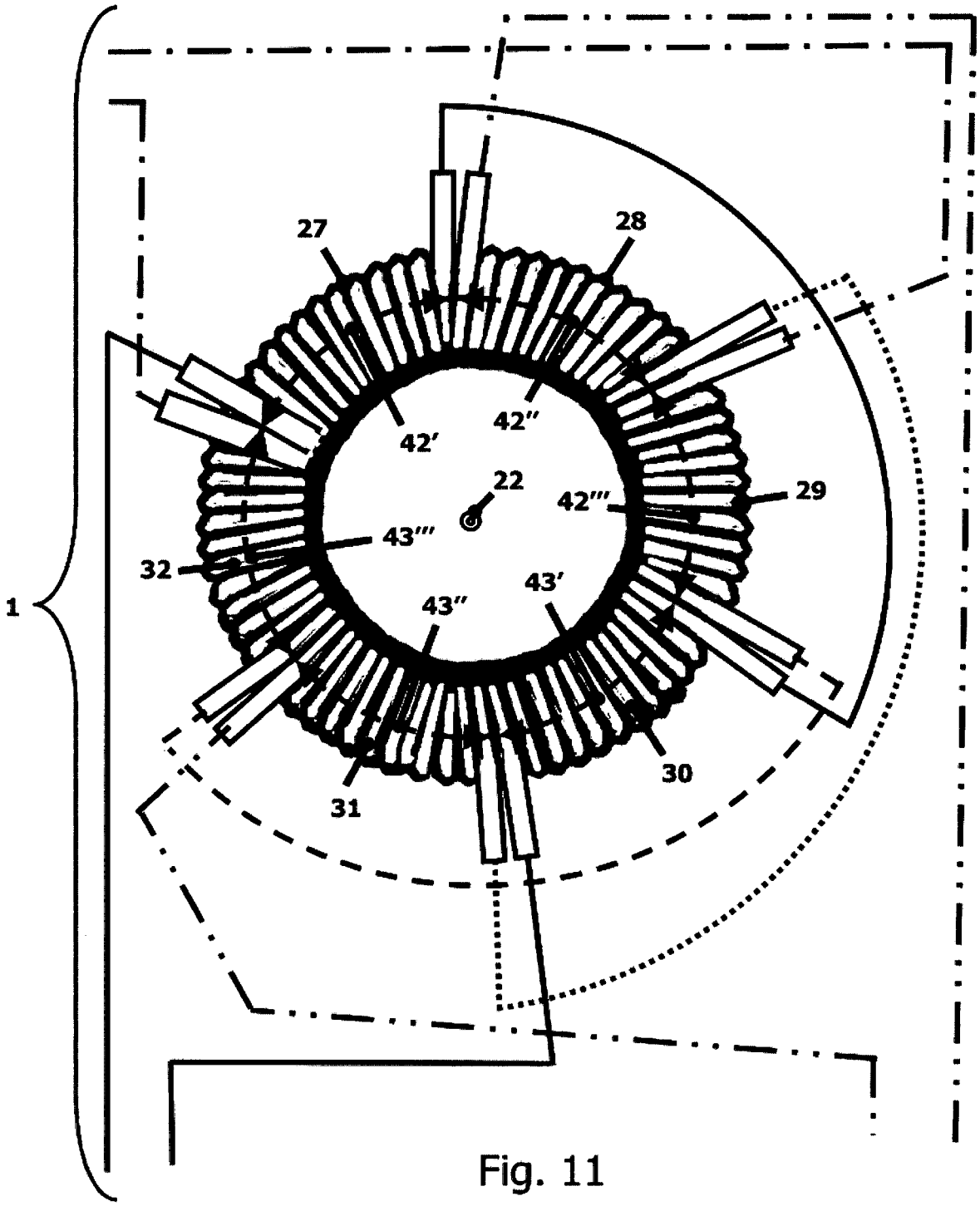
FIG. 11 schematically shows a possible embodiment of the internal winding of the stirrer according to the invention and of its connections.
Figure 12:
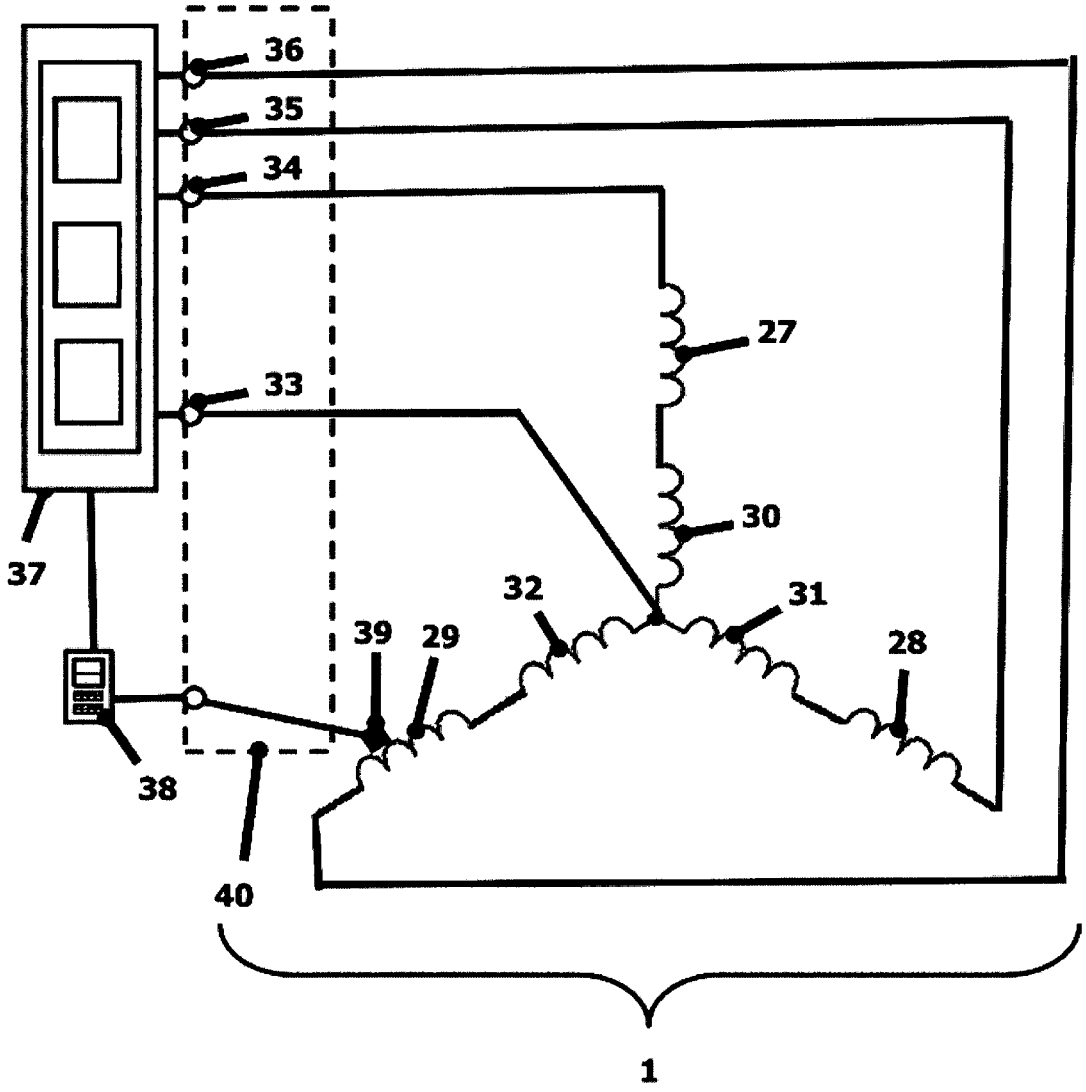
FIG. 12 schematically shows a connection diagram of the stirrer of FIG. 11 with a respective driving system.

In a preferred, non-limiting embodiment (FIG. 11, FIG. 12), the winding (7) consists of 6 groups of winding coils (27, 28, 29, 30, 31, 32), the groups of coils (27, 28, 29, 30, 31, 32) being evenly spaced from one another and each of the groups of coils (27, 28, 29, 30, 31, 32) having a number of coils equal to that of another group of the groups of coils (27, 28, 29, 30, 31, 32). As explained, the winding of the groups of winding coils is around the internal core (6) in the form of a torpid. Opposite groups of coils (27, 28, 29, 30, 31, 32) with respect to the central axis (22) of symmetry of the stirrer are connected in series. For example (FIG. 11,), in a configuration with 6 groups of coils (27, 28, 29, 30, 31, 32), along the toroidal configuration of the core (6) there are in sequence:

- a first group of coils (27);
- a second group of coils (28) in which the first coil of the second group of coils (28) is in a condition of proximity to the last coil of the first group of coils (27);
- a third group of coils (29) in which the first coil of the third group of coils (29) is in a condition of proximity to the last coil of the second group of coils (28);
- a fourth group of coils (30) in which the first coil of the fourth group of coils (30) is in a condition of proximity to the last coil of the third group of coils (29);
- a fifth group of coils (31) in which the first coil of the fifth of coils (31) is in a condition of proximity to the last coil of the fourth group of coils (30);
- a sixth group of coils (32) in which the first coil of the sixth group of coils (32) is in a condition of proximity to the last coil of the fifth group of coils (31) and the last coil of the sixth group of coils (32) is in a condition of proximity to the first coil of the first group of coils (27).

The connection in series of opposite groups of coils (27, 28, 29, 30, 31, 32) with respect to the central axis (22) of symmetry of the stirrer thus occurs by connecting (FIG. 11, FIG. 12):

- the last coil of the first group of coils (27) to the first coil of the fourth group of coils (30) realizing a first series (27, 30) of groups of coils provided with a first supply termination (34) and a common connection termination of the first series;
- the last coil of the second group of coils (28) to the first coil of the fifth group of coils (31) realizing a second series (28, 31) of groups of coils provided with a second supply termination (35) and a common connection termination of the second series;
- the last coil of the third group of coils (29) to the first coil of the sixth group of coils (32) realizing a third series (29, 32) of groups of coils provided with a third supply termination (36) and a common connection termination of the third series.

The common connection termination of each of the series, that is to say, of the first series (27, 30), second series (28, 31), third series (29, 32), is connected at a common connection point to three pairs of bobbins in series in such a way as to form the common centre of star connection (33) of a three-phase electrical connection further comprising the first supply termination (34) of the first series (27, 30) of groups of coils, the second supply termination (35) of the second series (28, 31) of groups of coils, the third supply termination (36) of the third series (29, 32) of groups of coils.

The common centre of star connection (33), the first supply termination (34) of the first series (27, 30) of groups of coils, the second supply termination (35) of the second series (28, 31) of groups of coils, the third supply termination (36) of the third series (29, 32) of groups of coils are connected (FIG. 12) to a three-phase supply switchboard (37), which provides on the first series (27, 30), second series (28, 31) and third series (29, 32) of groups of coils supply currents of the stirrer (FIG. 13) in the form of a current of the first series ($I_{34}$), current of the second series ($I_{35}$), current of the third series ($I_{36}$) respectively, the currents being reciprocally phase-shifted according to the phase-shift of the three-phase supply. Thanks to the supply currents of the stirrer, the stirrer generates a rotating magnetic field. In particular, by defining as 0 the electrical phase-shift of one of the series, for example taking the first series (27, 30) as a reference, the successive phase-shift present on the second series (28, 31) will be of 240 degrees and the phase-shift present on the third series (29, 32) will be of 120 degrees.

It will be evident to a person skilled in the art that, although a preferred embodiment (FIG. 11, FIG. 12) in which the winding (7) consists of 6 groups of winding coils (27, 28, 29, 30, 31, 32) has been described, it is possible to provide alternative solutions in which the winding (7) consists of a greater or smaller number of groups of suitably controlled winding coils, by means of the application of sequentially phase-shifted currents between the successive groups of winding coils. For example, one can provide solutions with 5, 7, 8, 9, 10, 11, 12 successive groups of winding coils driven by means of the application of sequentially phase-shifted currents in order to create the desired rotating field.

Therefore, the stirrer (1) is a stirrer (1) comprising (FIG. 6) a toroidal core (6), on which toroid the winding (7) is made within which the current generating the electromagnetic field of stirring of the molten metal bath (19) of aluminium or aluminium alloys inside the mould circulates, the winding (7) being made in the form of at least one series of winding coils wound on a winding plane (23) that is (FIG. 6) arranged according to an essentially radial direction (24) with respect to the central axis (22) of symmetry of the stirrer (1) or to the toroidal shape of the core (6).

Therefore, the stirrer (1) is not a stirrer of the known type with salient poles that is commonly used in other types of applications. By the salient pole technology, in fact, it would not be possible to realize a high-performing stirrer that complies with the size constraints imposed by the geometry of the casting machine. The presented solution, in fact, has a considerable advantage in terms of installation compactness because the presence of the salient poles considerably increases the external diameter of the stirrer.

Furthermore, the stirrer (1) according to the invention stands out with respect to the known solutions of stirrers producing repulsion forces, because the stirrer according to the invention is, in all respects, a rotary stirrer devoid of salient poles and configured and structured for the generation of a rotating electromagnetic field (FIG. 9, FIG. 10) of the molten metal bath (19) of aluminium or aluminium alloys inside the mould.

The core (6) is made of ferromagnetic material, such as carbon steel, silicon steel, termites or similar materials. It can consist of one single block, divided into several parts or sheets that are arranged or fixed next to each other to obtain a winding (7), For example, the core (6) can be made by means of a set of laminations.

In an embodiment the electromagnetic stirring device (1) can comprise (FIG. 5) a body (2) constituting a containment casing of the core (6) with the one or more windings of conductor in the form of groups of coils (7, 27, 28, 29, 30, 31, 32). The core (6) and the respective winding (7) are positioned inside the body (2) of the stirrer (1). The remaining internal space (5) with respect to the volume of the seat defined inside the body (2) and to the filling of the seat by the insertion of the core (6) with the winding (7) can be filled with filling material. This material has an anti-vibration function, it thus makes the magnetic core (6) comprising the windings integral with the body (2) of the stirrer (1) made of metal material. The filling material also promotes temperature exchange by transmitting the heat generated by the current circulating in the winding (7) outwards of the stirrer.

In an embodiment (FIG. 14) the body (2) can be made in the form of a casing of refractory material (44) containing on its inside the core (6) with the one or more windings, that is to say, the body (2) will not include a metal structural work constituting a containment casing of the core and of the windings, such solution making more effective the stirring action induced by the rotating magnetic field generated with a driving current having the same intensity.

The stirrer (1) is preferably provided (FIG. 7, FIG. 15) with a supporting plate (10) that is positioned above the installation seat (9) of the stirrer (1) inside the mould (8). The supporting plate (10) enables a more precise assembly with reference to a centering condition with respect to the mould itself and also allows reducing the effect of any possible vibrations.

The fastening occurs by means of a fastening system (4) that can be integrated in the body (2) of the stirrer (1) itself. For example, the fastening system (4) can include a set of screws that protrude from the body (2) of the stirrer and that are intended for the application of corresponding fastening nuts for the fastening on the supporting plate (10). As an alternative, one can also provide some screwing seats of locking screws of the stirrer (1) on the supporting plate (10).

In the solution provided with a fastening system (4) composed of a set of screws that protrude from the body (2) of the stirrer the screws are welded on the internal toroidal core (6), such solution being advantageous because it allows to obtain greater mechanical stability and greater resistance and insensitiveness to vibrations. The welding can occur with the aid of a fastening bracket (26)

For example one can provide a stirrer (1) having an internal diameter of the body (2) of about 300 mm and an external diameter of about 390 mm, with a height of the body (2) of about 45 mm. Such dimensions are particularly suitable for moulds intended for casting bars of aluminium or aluminium alloys having a diameter between 300 and 380 mm.

In general, the stirrer (1) can have a body (2) having an internal diameter between 100 and 400 mm, an external diameter between 140 and 480 mm, with a height of the body (2) between 40 and 80 mm.

The stirrer (1) is intended to be supplied with a sinusoidal current having a frequency between 5 Hz and 50 Hz and a current having an Irms value between 5 and 10 A at a driving voltage having a Vrms value between 20 and 100 V. In particular the optimal frequency of use can be selected depending on the size of the metal bar produced, that is to say, depending on the cast format. In detail, the frequency of use can be greater for smaller-sized cast sections and lower for larger-sized cast sections. In other words, the frequency of use increases upon reduction of the cast section. For example, one can provide a frequency of 10 Hz for a round format having a diameter of 330 mm, a frequency of 30 Hz for a round format having a diameter of 150 mm.

Advantageously, the stirrer (1) does not require a dedicated cooling circuit. Owing to its characteristics, in fact, the stirrer does not need to be cooled for its correct operation at the previously indicated current and frequency values.

The section of the wire of the wound material, in fact, is such as to considerably reduce Joule effect losses and thus the thermal power to be dissipated. The solution allows making a more compact stirrer, because one does not have to provide channels inside the stirrer for a correct cooling and the necessary space in the terminal board for the connection of the cooling fluid pipes.

Below are indicative values concerning the electromagnetic performance of the stirrer (1) according to the invention. In particular, one can see the forces induced by the stirrer on liquid aluminium for driving current and frequency values of 7.5 A and 10 Hz respectively. The forces induced by the stirrer are indicated on a horizontal plane. The stirrer (1) induces (FIG. 9, FIG. 10) in the molten metal (19) of aluminium or aluminium alloys inside the mould (8) a rotating pattern of forces. Since the stirrer is made up of a closed ring, the forces are constant along the entire angular extension of the mould (8) and, consequently, along the entire angular extension of the molten metal (19) of aluminium or aluminium alloys inside the mould (8).

With reference (FIG. 9) to a horizontal plane passing through the centre of the annular body (2) of the stirrer in correspondence of the central axis (22), one obtains rotation speeds of the molten metal (19) of aluminium or aluminium alloys up to values ranging from 0.1 to 1 m/s, such 0.6 m/s, wherein the arrows represent the speed vectors of the molten metal (19) and the longer arrows correspond to higher speeds.

With reference (FIG. 10) to a horizontal plane corresponding to the position of the level (15) in the mould, one obtains rotation speeds of the molten metal (19) of aluminium or aluminium alloys of values up to 0.5 m/s, wherein the arrows represent the speed vectors of the molten metal (19) and the longer arrows correspond to higher speeds.

Figure 9:
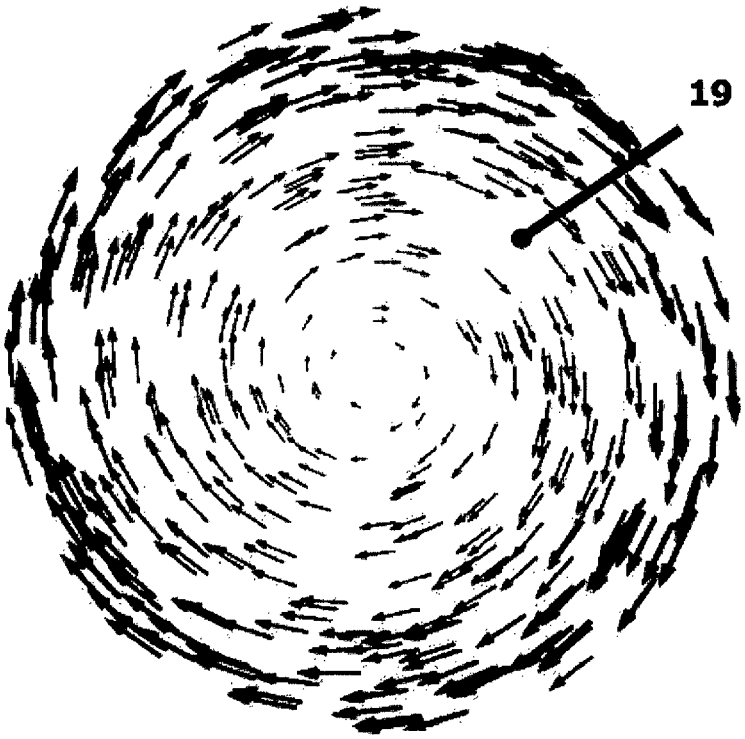
FIG. 9 is a schematic view of the stirring induced on the liquid bath of aluminium or aluminium alloys inside a mould incorporating on its inside a stirrer made according to the present invention, wherein the view refers to the effect obtained in correspondence of a plane passing through the central axis of the stirrer.
Figure 10:
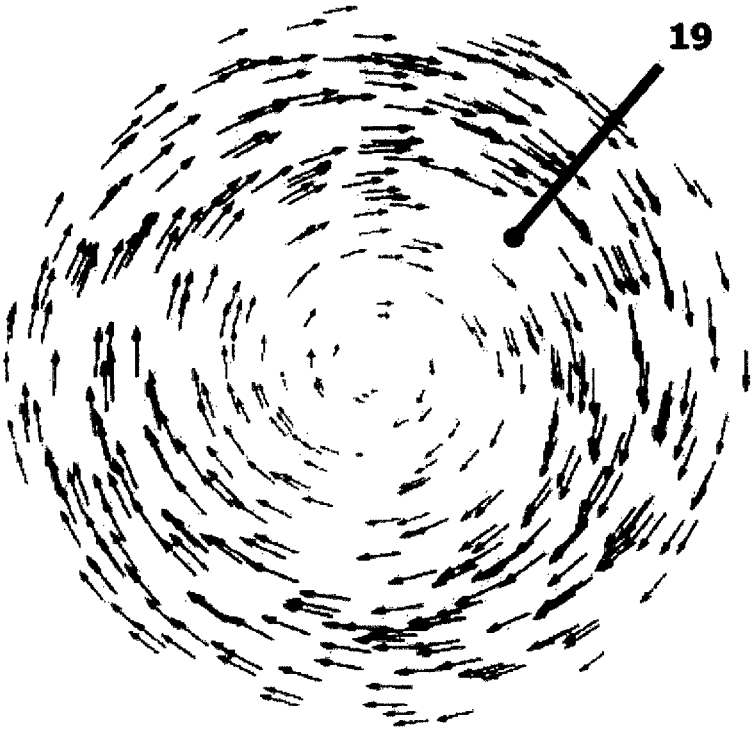
FIG. 10 is a schematic view of the stirring induced on the liquid bath of aluminium or aluminium alloys inside a mould incorporating on its inside a stirrer made according to the present invention, wherein the view refers to the effect obtained in correspondence of the meniscus.

From the two figures (FIG. 9, FIG. 10) one can see that the induced motion is rotational in both sections, and that the speed is kept high on the meniscus (FIG. 10) as well, although being far from the zone of forced stirring by the stirrer (FIG. 9).

The maximum speed values are obtained in the section change zone or joint zone (12) and in the zone in correspondence of the graphite ring (13).

It should be noted that the configuration according to the invention allows to obtain a considerably improved performance with respect to any existing stirrer applications with known configurations, which would lead to 50% lower rotational speed values that would not be able in any case to provide uniform stirring on such a wide zone starting from the meniscus (15) and arriving at the section change zone or joint zone (12).

If, on the other hand, one analyses the arrangement of the forces along a vertical section of the molten metal (19) of aluminium or aluminium alloys, the forces are more intense in the zone of the mould in which the section change occurs due to the presence of the joint zone (12) between an introduction portion (14) of the mould (8) and a solidification starting zone (20) arranged in correspondence of the graphite ring (13), which has a larger diameter than the diameter of the introduction portion (14) of the molten metal (19). That is to say, the forces are more intense in the zone of the mould that is arranged transversely on the plane corresponding to that of the stirrer (1). In other words, the stirring induced on the liquid bath of aluminium or aluminium alloys inside the mould is (FIG. 9) greater in correspondence of a plane passing through the centre of the annular body (2) of the stirrer in correspondence of the axis (22).

The obtained results are such as to obtain stirring forces placed towards the most interesting zone, that is to say, the one corresponding to the graphite ring (13), thus obtaining the most advantageous conditions with respect to the desired stirring effect for the homogenization of the bath and the reduction in the occurrence of defects on the surface.

Furthermore, the effect of the stirrer upon changing the driving frequency of the stirrer was analysed, observing the torque transferred from the stirrer to the molten metal (19) of aluminium or aluminium alloys according to the supply frequency of the stirrer itself: one obtains a maximum value for driving frequencies of approximately between 5 and 15 Hz, preferably of 10 Hz. For higher driving frequency values, the transferred torque decreases upon increase of the frequency. When operating with driving frequencies approximately between 5 and 15 Hz, preferably of 10 Hz, the effect of the stirrer is maximized and electrical consumptions are optimized.

Although in the illustrated embodiment (FIG. 8) of a casting bench (17) reference is made to a solution with a series of six moulds, each incorporating on its inside a stirrer made according to the present invention, it will be evident that the present invention can also be applied to casting benches having a smaller or greater number of moulds.

The formats of products in the form of bars of aluminium or aluminium alloys that can be cast by means of the mould (8) can be, for example, bars having a circular cross section and having a diameter between 100 and 400 mm, corresponding to the diameter of the mould (8) in correspondence of the solidification starting zone (20), below the section change zone or joint zone (12).

The stirrer (1) is provided with a monitoring system for monitoring the temperature of the internal windings, which is necessary to send over-temperature alarms. For example, in correspondence of at least one of the internal windings, one can fix a temperature measuring system (39), for example (FIG. 12) in the form of a thermocouple that, in a continuous way, detects the temperature thereof. The signal of the temperature measuring system (39) is monitored by a control unit (38) that, upon exceeding a given threshold, interrupts the operation of the system by acting on the driving inverter of the stirrer (1).

The stirrer (1) will be preferably supplied by means of a respective inverter switchboard with a transformer and a local junction box situated in the vicinity of the mould (8), the local Junction box being optionally intended for the connection of a greater number of stirrers (1) in case of installations on casting benches (17) provided with more moulds (8). To conclude, the present invention relates to (FIG. 1, FIG. 2, FIG. 3, FIG. 4, FIG. 5, FIG. 6, FIG. 14) an electromagnetic stirring device (1) for (FIG. 7, FIG. 8, FIG. 15) a mould (8) for casting molten metal (19) of aluminium or aluminium alloys, wherein the electromagnetic stirring device (1) comprises a winding core (6) and one or more windings of conductor In the form of groups of conductive coils (7, 27, 28, 29, 30, 31, 32) intended for the circulation of a current generating an electromagnetic field of stirring of molten metal (19) of aluminium or aluminium alloys inside the mould (8). The core (6) has a toroidal shape constituting a supporting element for the one or more windings in the form of groups of coils (7, 27, 28, 29, 30, 31, 32) according to a configuration in which the coils of the one or more windings in the form of groups of coils (7, 27, 28, 29, 30, 31, 32) are wound around the core (6) on a winding plane (23) that is arranged according to an essentially radial direction (24) with respect to a central axis (22) of symmetry of the toroidal shape of the core (6). The one or more windings in the form of groups of coils (7, 27, 28, 29, 30, 31, 32) preferably comprise pairs of group (7, 27, 28, 29, 30, 31, 32 in which each pair r- or of groups of coils (7, 27, 28, 29, 30, 31, 32) consists of two groups of coils (7, 27, 28, 29, 30, 31, 32) in which:

- one group of coils 'of the pair is wound on the core (6) along a first arc (42', 42", 42'9) of the toroidally shaped development of the core (6);
- the other group of coils of the pair is wound on the core (6) along a second arc (43', 43", 43'") of the toroidally shaped development of the core (6);
- the first arc (42', 42", 42'") and the second arc (43', 43", 43'") being reciprocally opposite arcs with respect to the axis (22) of the toroidal shape of the core (6).

The groups of coils (7, 27, 28, 29, 30, 31, 32) of each of the pairs of groups of coils (7, 27, 28, 29, 30, 31, 32) are reciprocally connected (FIG. 11, FIG. 12) according to a configuration of connection in series in which each pair of groups of coils (7, 27, 28, 29, 30, 31, 32) comprises a first connection end and a second connection end and an intermediate connection with respect to the groups of coils (7, 27, 28, 29, 30, 31, 32) of the respective pair of groups of coils (7, 27, 28, 29, 30, 31, 32). The second connection end of each of the pairs of groups of coils (7, 27, 28, 29, 30, 31, 32) is connected to respective second ends of the other pairs of groups of coils (7, 27, 28, 29, 30, 31, 32) at a common connection point constituting a common centre of star connection (33). In this way, the assembly of the first connection ends of each of the pairs of groups of coils (7, 27, 28, 29, 30, 31, 32) constitutes the connection interface with a supply system of reciprocally phase-shifted sinusoidal currents with respect to the common centre of star connection (33), wherein the current of each of the pairs of groups of coils (7, 27, 28, 29, 30, 31, 32) is phase-shifted with respect to the current of the adjacent pairs of groups of coils (7, 27, 28, 29, 30, 31, 32) along the toroidal shape of the core (6) for the generation of a rotating electromagnetic field of stirring of the molten metal (19) of aluminium or aluminium alloys inside the mould (8).

In a preferred, non-limiting embodiment, the groups of coils (27, 28, 29, 30, 31, 32) consist.

(FIG. 11, FIG. 12) of six groups of coils (27, 28, 29, 30, 31, 32) comprising the previously defined first group of coils (27), second group of coils (28), third group of coils (29), fourth group of coils (30), fifth group of coils (31), sixth group of coils (32). In particular, the six groups of coils (27, 28, 29, 30, 31, 32) comprise three pairs of groups of coils (7, 27, 28, 29, 30, 31, 32) in which:

- a first pair of groups of coils consists of the first group of coils (27) wound along a first arc (42') of the first pair of groups of coils and of the fourth group of coils (30) wound along a second arc (43') of the first pair of groups of coils;
- a second pair of groups of coils consists of the second group of coils (28) wound along a first arc (42") of the second pair of groups of coils and of the fifth group of coils (31) wound along a second arc (43") of the second pair of groups of coils;
- a third pair of groups of coils consists of the third group of coils (29) wound along a first arc (42'") of the third pair of groups of coils and of the sixth group of coils (32) wound along a second arc (43'") of the third pair of groups of coils.

Preferably, the length of the first arc (42') of the first pair of groups of coils, of the second arc (43') of the first pair of groups of coils, of the first arc (42") of the second pair of groups of coils, of the second arc (43") of the second pair of groups of coils, of the first arc (42'") of the third pair of groups of coils and of the second arc (43'") of the third pair of groups coils is the same.

Each group of the groups of coils (7, 27, 28, 29, 30, 31, 32) preferably has a number of winding coils equal to the number of winding coils of the others groups of the groups of coils (7, 27, 28, 29, 30, 31, 32).

As previously explained, the electromagnetic stirring device (1) according to the invention, thanks to the described characteristics, allows to obtain a stirrer devoid of a cooling system by means of fluids circulating inside the electromagnetic stirring device (1) and also devoid of salient poles.

The present invention also relates to (FIG. 7, FIG. 15) a mould (8) for the solidification of a metal bar solidified from molten metal (19) of aluminium or aluminium alloys, wherein the mould (8) is of the type provided with:

- a lower opening that is open for the extraction of the solidified metal bar;
- an introduction portion (14) of the molten metal (19) opposite with respect to the opening for the extraction of the solidified metal bar;
- a solidification starting zone (20) for the solidification of the molten metal (19) of aluminium or aluminium alloys positioned between the opening for the extraction of the solidified metal bar and the introduction portion (14) of the molten metal (19);
- an electromagnetic stirring device (1) of the molten metal (19) of aluminium or aluminium alloys, wherein the electromagnetic stirring device (1) is housed in a seat (9) of the mould (8), the electromagnetic stirring device (1) comprising a winding core (6) having a toroidal shape and one or more windings of conductor in the form of groups of conductive coils (7, 27, 28, 29, 30, 31, 32) intended for the circulation of a current generating an electromagnetic field of stirring of molten metal (19) of aluminium or aluminium alloys inside the mould (8), the core (6) constituting a supporting element having a winding section with a centre (C) around which the one or more windings are wound.

In particular, the installation can provide the stirrer (1) to be positioned at a specific distance (S) with respect to the solidification starting zone (20) for the solidification of the molten metal (19) of aluminium or aluminium alloys inside the mould (8).

In particular, considering (FIG. 7, FIG. 15) the centre (C) of the toroidal winding core of the stirrer, the optimal installation is conceived in such a way that the seat (9) of the mould (8) for housing the electromagnetic stirring device (1) of the molten metal (19) of aluminium or aluminium alloys is obtained inside the mould (8) in such a position that the centre (C) is arranged at a distance (S) from one of the ends of the solidification starting zone (20) between +/−140 mm, even more preferably between +/−100 mm.

The mould (8) is preferably of the type further comprising a ring (13) that promotes the solidification of the molten metal (19), the ring (13) being positioned in correspondence of the solidification starting zone (20). In case of moulds provided with a ring (13) that promotes solidification, the optimal installation is conceived in such a way that the seat (9) of the mould (8) for housing the electromagnetic stirring device (1) of the molten metal (19) of aluminium or aluminium alloys is obtained inside the mould (8) in such a position (FIG. 7, FIG. 15) that the centre (C) of the winding section of the core (6) is arranged at a distance (U) from an intermediate plane (25) of vertical extension of the ring (13) between +/−170 mm, preferably between +/−150 mm.

The mould (8) is preferably of the type in which the solidification starting zone (20) has a greater overall width with respect to the overall width of the introduction portion (14) of the molten metal (19), the solidification starting zone (20) and the introduction portion (14) being joined to each other by a joint portion (12) which comprises an inclined portion joining the solidification starting zone (20) and the introduction portion (14) having different widths. Even more preferably, the mould (8) comprises a feeding mouth (11) of the molten metal (19) of aluminium or aluminium alloys, the feeding mouth (11) being obtained in the form of a side vertical notch in correspondence of a side of the introduction portion (14) of the molten metal (19).

The present invention also relates to a stirring method in a mould (8) for casting aluminium or aluminium alloys, wherein the method comprises a phase of supply of an electromagnetic stirring device (1) of the molten metal (19) inside the mould (8), the phase of supply of the electromagnetic stirring device (1) being a phase of supply of one or more windings of conductor wound around a winding core (6) having a toroidal shape, the one or more windings of conductor being wound in the form of groups of conductive coils (7, 27, 28, 29, 30, 31, 32) intended for the circulation of a current generating an electromagnetic field of stirring of molten metal (19) of aluminium or aluminium alloys inside the mould (8), wherein the phase of supply of the one or more windings of conductor wound in the form of groups of coils (7, 27, 28, 29, 30, 31, 32) is a phase of supply with reciprocally phase-shifted sinusoidal supply currents of pairs of groups of coils (7, 27, 28, 29, 30, 31, 32) wound around the core (6) on a winding plane (23) that is arranged according to an essentially radial direction (24) with respect to an axis (22) of the toroidal shape of the core (6), wherein each pair of groups of coils (7, 27, 28, 29, 30, 31, 32) consists of two groups of coils (7, 27, 28, 29, 30, 31, 32), in which:

- one group of coils of the pair is wound on the core (6) along a first arc (42', 42", 42'") of the toroidally shaped development of the core (6);
- the other group of coils of the pair is wound on the core (6) along a second arc (43', 43", 43'") of the toroidally shaped development of the core (6);
- the first arc (42', 42", 42'") and the second arc (43', 43", 43'") being reciprocally opposite arcs with respect to the axis (22) of the toroidal shape of the core (6), said phase of supply with reciprocally phase-shifted sinusoidal supply currents generating a rotating magnetic field inducing the stirring of the molten metal (19) inside the mould (8).

The method is conceived in such a way that, preferably, the groups of coils (7, 27, 28, 29, 30, 31, 32) of each of the pairs of groups of coils (7, 27, 28, 29, 30, 31, 32) are connected to one another (FIG. 11, FIG. 12) according to a configuration of connection in series, as previously explained and, more in detail, to the common centre of star connection (33).

The present invention also relates to a casting machine of aluminium or aluminium alloys for the solidification of a series of metal bars solidified from molten metal (19) of aluminium or aluminium alloys, wherein the casting machine comprises a casting bench (17) provided with a base (16) for mounting a series of moulds (8) fed by a distribution channel (18) of the molten metal (19) in the form of aluminium or aluminium alloys, wherein at least one of the moulds (8) is a mould (8) as previously described.

The present invention also relates to a casting machine of aluminium or aluminium alloys for the solidification of a series of metal bars solidified from molten metal (19) of aluminium or aluminium alloys, wherein the casting machine comprises a casting bench (17) provided with a base (16) for mounting a series of moulds (8) fed by a distribution channel (18) of the molten metal (19) in the form of aluminium or aluminium alloys, wherein at least one of the moulds (8) comprises an electromagnetic stirring device (1) of the molten metal (19) of aluminium or aluminium alloys made in compliance with what has been previously explained.

The present invention also relates to a plant for producing and machining bars of aluminium or aluminium alloys, wherein the plant comprises a casting machine of aluminium or aluminium alloys for the solidification of a series of metal bars solidified from molten metal (19) of aluminium or aluminium alloys as previously described, in particular comprising a mould provided with the electromagnetic stirring device having the described characteristics or installed according to an arrangement with respect to a solidification zone or operating according to the described method.

The description of the present invention has been made with reference to the enclosed figures in a preferred embodiment, but it is evident that many possible changes, modifications and variations will be immediately clear to those skilled in the art in the light of the foregoing description. Thus, it should be understood that the invention is not limited to the foregoing description, but embraces all such changes, modifications and variations in accordance with the appended claims.

NOMENCLATURE USED

With reference to the identification numbers reported in the enclosed figures, the following nomenclature has been used:

1. Stirrer or electromagnetic stirring device
2. Body
3. Connections
4. Fastening system
5. Internal space
6. Core
7. Winding
8. Mould
9. Seat
10. Supporting plate
11. Mouth
12. Joint portion
13. Ring
14. Introduction portion or vessel of refractory material
15. Level
16. Base
17. Casting bench
18. Distribution channel
19. Metal in the molten state
20. Solidification starting zone
21. Introduction channel
22. Axis
23. Winding plane
24. Radial direction
25. Intermediate plane
26. Bracket
27. First group of coils
28. Second group of coils
29. Third group of coils
30. Fourth group of coils
31. Fifth group of coils
32. Sixth group of coils
33. Common centre of star connection
34. First termination
35. Second termination
36. Third termination
37. Three-phase supply switchboard
38. Control unit
39. Temperature measuring system
40. Terminal board or connector
41. Solidification front
42'. First arc of the first pair of groups of coils
42". First arc of the second pair of groups of coils
42". First arc of the third pair of groups of coils
43'. Second arc of the first pair of groups of coils
43". Second arc of the second pair of groups of coils
43'". Second arc of the third pair of groups of coils
44. Refractory material
C. Centre of the core of the stirrer
D. Diameter
R. Radius
S. Distance from the solidification starting zone
U. Distance from the solidification promoting ring

The invention claimed is:

1. An electromagnetic stirring apparatus for a mold used for casting molten metal of aluminum or aluminum alloys, the electromagnetic stirring apparatus comprising:

a winding core;

at least one winding of a conductor in a conductive coil form adapted to generate an electromagnetic field, said winding core having a toroidal shape and supporting said at least one winding, said at least one winding being wound around said winding core on a winding plane extending in a radial direction with respect to a central axis of the toroidal shape of said winding core, said at least one winding comprising pairs of groups of coils in which each pair of groups of coils comprises two groups of coils in which each of the two groups of coils are reciprocally connected in series, wherein each pair of groups of coils has a first connection end and a second connection end, the second connection end being respectively connected to second ends of another pair of groups of coils at a common connection point, the common connection point being a center of a star connection, the first connection end of each of the pair of groups of coils having a connection interface with a supply system of reciprocally phase-shifted sinusoidal currents with respect to the center of the star connection, a current of each of the pairs of groups of coils being phase-shifted with respect to a current of an adjacent pair of groups of coils along the toroidal shape of the core so as to generate a rotating electromagnetic field for stirring of the molten metal of aluminum or aluminum alloys.

2. The electromagnetic stirring apparatus of claim 1, wherein each of the pairs of groups of coils has one group of coils wound around the core along a first arc of the toroidal shape of the core and another of the group of coils wound on the core along a second arc of the toroidal shape of the core, the first arc and the second arc being reciprocally opposite arcs relative to the central axis of the toroidal shape of the core.

3. The electromagnetic stirring apparatus of claim 1, wherein the sinusoidal currents each has a frequency of between 5 Hz and 50 Hz.

4. The electromagnetic stirring apparatus of claim 1, wherein the pairs of groups of coils comprises six groups of coils, the six groups of coils comprising:

a first group of coils;

a second group of coils in which a first coil of the second group of coils is adjacent to a last coil of the first group of coils;

a third group of coils in which a first coil of the third group of coils is adjacent to a last coil of the second group of coils;

a fourth group of coils in which a first coil of the fourth group of coils is adjacent to a last coil of the third group of coils;

a fifth group of coils in which a first coil of the fifth group of coils is adjacent to a last coil of the fourth group of coils; and a sixth group of coils in which a first coil of the sixth group of coils is adjacent to a last coil of the fifth group coils, wherein a last coil of the sixth group of coils is adjacent to a first coil of the first group of coils.

5. The electromagnetic stirring apparatus of claim 1, wherein the pairs of groups of coils comprise three pairs of groups of coils comprising:

a first pair of groups of coils having a first group of coils wound along a first arc of the first pair of groups of coils and a fourth group of coils wound along a second arc of the first pair of groups of coils;

a second pair of groups of coils having a second group of coils wound along a first arc of a second pair of groups of coils and a fifth group of coils wound along a second arc of the second pair of groups of coils; and a third pair of groups of coils having a third group of coils wound along a first arc of the third pair of groups of coils and a sixth group of coils wound along a second arc of the third pair of groups of coils.

6. The electromagnetic stirring apparatus of claim 5, wherein a length of the first arc of the first pair of groups of coils and a length of the second pair of groups of coils and a length of the first arc of the second pair of groups of coils and a length of the second arc of the second pair of groups of coils and a length the first arc of the third pair of groups of coils and a length of the second arc of the third pair of groups of coils are identical.

7. The electromagnetic stirring apparatus of claim 5, wherein a last coil of the first group of coils is connected to a first coil of the fourth group of coils to form a first series of groups of coils having a first supply termination and a common connection termination of the first series, wherein a last coil of the second group of coils is connected to the first coil of the fifth group of coils so as to form a second series of groups of coils having a second supply termination and a common connection termination of the second series, wherein a last coil of the third group of coils is connected to the first coil of the sixth group of coils so as to form a third series of groups of coils having a third supply termination and a common connection termination of the third series.

8. The electromagnetic stirring apparatus of claim 7, wherein the common connection termination of the first series and the common connection termination of the second series and the common connection termination of the third series is connected at the center of the star connection.

9. The electromagnetic stirring apparatus of claim 8, wherein the supply system is a three-phase supply and supplies current to the first series and the second series and third series, the current being reciprocally phase-shifted according to a phase-shift of the three-phase supply.

10. The electromagnetic stirring apparatus of claim 1, wherein each of the groups of coils has a number of winding coils equal to a number of winding coils of the other groups of coils.

11. The electromagnetic stirring apparatus of claim 10, wherein the number of winding coils is between 50 and 200 coils.

12. The electromagnetic stirring apparatus of claim 1, wherein the core is formed of a ferromagnetic material.

13. The electromagnetic stirring apparatus of claim 12, wherein the core is selected from one single block having the toroidal shape and sheets or portions thereof arranged next to one another to form the toroidal shape.

14. The electromagnetic stirring apparatus of claim 1, wherein the toroidal shape has a circular cross section.

15. The electromagnetic stirring apparatus of claim 1, further comprising:

a body forming a containment casing of the core.

16. The electromagnetic stirring apparatus of claim 15, wherein said body is a metal container having an insertion seat for the core with an interior thereof, the electromagnetic stirring apparatus further comprising:

a filling material received in a remaining space of the metal container.

17. The electromagnetic stirring apparatus of claim 15, wherein said body is a casing of refractory material having the core on an interior thereof.

18. The electromagnetic stirring apparatus of claim 15, wherein said body with a flat upper portion joined to side portions and a lower portion having a shape selected from the group consisting of a quadrangular shape, a circular shape, and a polygonal shape.

19. The electromagnetic stirring apparatus of claim 1, wherein the electromagnetic stirring apparatus is devoid of a fluid circulating cooling system therein.

20. The electromagnetic stirring apparatus of claim 1, wherein the electromagnetic stirring apparatus is devoid of salient poles.

21. A casting machine having the electromagnetic stirring apparatus of claim 1, wherein the casting machine has a casting bench with a base, the casting bench adapted to receive a series of molds fed by a distribution channel.

22. A plant for producing and machining bars of aluminum or aluminum alloys, wherein the plant has a casting machine of claim 21.

23. A mold for solidification of a metal bar from molten metal of aluminum or aluminum alloys, the mold comprising:

a lower opening having an opening through which the metal bar is extracted;

an introduction portion opposite to said lower opening, said introduction portion adapted to allow the molten metal to be introduced into the mold;

a solidification starting zone positioned between said lower opening and said introduction portion, said solidification starting zone allowing for the solidification of the molten metal;

an electromagnetic stirring device housed in a seat in the mold, said electromagnetic stirring apparatus having a winding core having a toroidal shape and at least one winding in a form of groups of conductive coils and adapted to circulate a current that generates an electromagnetic field so as to stir the molten metal inside the mold, the winding coil being a supporting element having a winding section with a center around which the at least one winding is wound; and a ring adapted to promote the solidification of the molten metal, said ring positioned in said solidification starting zone, said solidification starting zone having a width greater than a width of said introduction portion, said solidification starting zone and said introduction portion being joined to each other by a joint portion, the joint portion having an inclined part joining said solidification starting zone and the introduction portion, wherein the seat houses said electromagnetic stirring apparatus inside the mold such that the center of the winding section is positioned at a distance of approximately ±140 millimeters from one end of said solidification starting zone, the center of the winding section being positioned at approximately ±170 millimeters from an intermediate plane of vertical extension of said ring.

24. The mold of claim 23, wherein said ring is formed of graphite material.

25. The mold of claim 23, further comprising:

a feeding mouth adapted to allow the molten metal to be fed into the mold, said feeding mouth being a side vertical notch at a side of said introduction portion.

26. A casting machine having a mold of claim 23, the casting machine has a casting bench with a base for mounting a series of the mold fed by a distribution channel.

27. An electromagnetic stirring system for stirring molten metal of aluminum or aluminum alloys, the electromagnetic stirring system comprising:

a mold;

an electromagnetic stirring apparatus positioned in said mold;

a current supply connected to said electromagnetic stirring apparatus, the current supply being at least one winding of conductor wound around a winding core, the winding core having a toroidal shape, the at least one winding being wound in groups of conductive coils that circulate a current that generates an electromagnetic field for the stirring of the molten metal, wherein said current supply has reciprocally phase-shifted sinusoidal supply currents of pairs of groups of coils wound around the core on a winding plane arranged in a radial direction with respect to a central axis of symmetry of the toroidal shape of the core, wherein each pair of groups of coils comprises two groups of coils, one group of the two groups of the coils being wound on the core along a first arc of the toroidal shape of the core and another group of coils of the two groups of coils being wound on the core along a second arc of the toroidal shape of the core, the first arc and the second arc being reciprocally opposite arcs with respect to the central axis of symmetry of the toroidal shape of the core.

28. The electromagnetic stirring system of claim 27, wherein the two groups of coils are connected to one another in series in which each pair of groups of coils has a first connection end and a second connection end and an intermediate connection end.

29. The electromagnetic stirring system of claim 28, wherein the second connection end of each of the pairs of groups of coils is connected to respective second ends of other pairs of groups of coils at a common connection joint, the common connection point being a common center of a star connection.

30. The electromagnetic stirring system of claim 29, wherein a first connection end of each of the pairs of groups of coils being a connection interface with the current supply with respect to the common center of the star connection, wherein a current of each of the pairs of groups of coils is phase-shifted with respect to a current of adjacent pairs of groups of coils along the toroidal shape of the core.

31. The electromagnetic stirring system of claim 27, wherein the sinusoidal current has a frequency of between 5 Hz and 50 Hz.

* * * * *